US006678976B2

(12) United States Patent
Jones

(10) Patent No.: US 6,678,976 B2
(45) Date of Patent: Jan. 20, 2004

(54) EYEGLASS IDENTIFICATION DEVICE

(75) Inventor: Peter A. Jones, Newton, MA (US)

(73) Assignee: Eyeglass Rescue, Inc., Newton, MA (US)

( * ) Notice: Subject to any disclaimer, the term of this patent is extended or adjusted under 35 U.S.C. 154(b) by 78 days.

(21) Appl. No.: 09/987,466

(22) Filed: Sep. 10, 2001

(65) Prior Publication Data

US 2002/0026732 A1 Mar. 7, 2002

Related U.S. Application Data

(63) Continuation-in-part of application No. 09/444,085, filed on Nov. 22, 1999, now abandoned.

(51) Int. Cl.[7] ..... G09F 3/10
(52) U.S. Cl. ..... 40/299.01; 40/660; 351/51
(58) Field of Search ..... 40/299.01, 316, 40/626, 660, 665; 206/497; 351/51, 52; D16/323, 341, 342

(56) References Cited

U.S. PATENT DOCUMENTS

| | | | | |
|---|---|---|---|---|
| 2,844,893 A | | 7/1958 | Keller | |
| 3,110,554 A | | 11/1963 | Yazumi | |
| 4,122,947 A | * | 10/1978 | Falla | 206/569 |
| 4,205,750 A | | 6/1980 | Dews | |
| 4,251,302 A | * | 2/1981 | Leonard et al. | 156/60 |
| 4,609,208 A | * | 9/1986 | Wrobel | 283/81 |
| 4,640,636 A | * | 2/1987 | Hofmann | 401/96 |
| 4,759,139 A | * | 7/1988 | Ricks | 40/638 |
| 4,806,008 A | | 2/1989 | Tarloff | |
| 4,893,840 A | | 1/1990 | Berkowitz | |
| 4,908,177 A | | 3/1990 | Hartner | |
| 5,000,804 A | * | 3/1991 | Nugent | 156/85 |
| 5,236,527 A | * | 8/1993 | Brodsky | 156/85 |
| 5,387,012 A | | 2/1995 | Hibbs | |
| 5,390,964 A | | 2/1995 | Gray, Jr. | |
| 5,957,604 A | | 9/1999 | Anderson | |
| 6,042,484 A | | 3/2000 | Streit | |
| 6,120,146 A | | 9/2000 | Harris | |

* cited by examiner

*Primary Examiner*—Brian K. Green
(74) *Attorney, Agent, or Firm*—Nutter McClennen & Fish LLP

(57) ABSTRACT

An identification device for eyeglass frames is provided. The identification device includes an identification sleeve adapted to couple with an eyeglass frame. This identification sleeve includes an identification marking. A non-toxic protective sleeve is superimposed over the identification sleeve and at least a portion of an eyeglass frame. This device does not accumulate dirt and bacteria and easily attaches to an eyeglass frame.

16 Claims, 2 Drawing Sheets

EYEGLASS IDENTIFICATION DEVICE

RELATED APPLICATION

This application is a continuation-in-part of U.S. patent application Ser. No. 09/444,085 entitled Eyeglass Identification Device And Recovery Method, filed Nov. 22, 1999, now abandoned.

BACKGROUND

Today many millions of people wear eyeglasses and many of these people are under the age of eighteen. The average price for a pair of prescription eyeglasses in the United States is over one hundred dollars. A pair of premium eyeglasses and frames may cost over five hundred dollars. Therefore, permanently losing a pair of eyeglasses and having to buy a new pair is expensive. Losing eyeglasses is also inconvenient because the eyeglass owner may have to schedule an appointment, special order a new frame and then have the lenses installed into the frames. Therefore, it may take days or weeks before the lost eyeglasses are replaced.

Every year, thousands of eyeglasses are lost and never recovered. By some estimates, over 50% of eyeglass owners have permanently lost their eyeglasses at least once. Adding to this problem is the fact that finders of eyeglasses usually have no way of identifying the owner of the lost eyeglasses.

One arrangement for identifying eyeglasses is engraving the owners name and telephone number on the glasses. One drawback to this method is that engraving leaves an impression in the frames that attracts dirt and bacteria. Also, engraving on an eyeglass frame requires an expensive piece of engraving machinery that is not typically carried in engraving stores. This equipment also has a minimum character size that limits the number of characters that will fit onto an eyeglass frame. In addition, owners may have privacy reservations with having their name and telephone number on their eyeglasses.

Another method of identification is using a flat label on the temple bar of the eyeglass frame. One drawback of this method is that repeated use may wear the identification marking off this label. Also the labels sometimes become loose and fall off. Lastly, using a flat label may reduce the aesthetic value of the eyeglasses.

Another proposed solution is having the inside of a frame recessed and putting a label in the recess. The label typically has the owners phone number and name or address. One drawback with this method is that the recess tends to attract dirt and bacteria. Putting a recess in frames is also expensive and tends to weaken the frames. In addition, there are privacy issues with having the owners phone number or address on his or her eyeglasses.

Thus, a need exists for an identification device for eyeglass frames that does not accumulate dirt and bacteria and easily attaches to eyeglass temple bars. In addition, there is a need for an identification marking that will not wear off after repeated uses. There is also a need for a convenient method for recovering a pair of lost eyeglasses.

SUMMARY

The present invention provides, in a first aspect, an identification device for eyeglass frames including a temple bar with a distal end configured for engagement with a user behind the user's ear. The identification device includes an identification sleeve configured for substantially concentric engagement with the distal end. Identification indicia is disposed on said identification sleeve, so that the indicia is configured for disposition behind the user's ear. The indicia is disposed on opposite sides of said identification sleeve. A substantially transparent non-toxic protective sleeve is superposed with said identification sleeve, and is fabricated from a non-toxic polymeric material.

In another aspect, the present invention is an identification device for eyeglass frames including a temple bar having a distal end configured for engagement with a user's head behind the user's ear. An identification sleeve is disposed in substantially concentric engagement with said distal end, and identification indicia is disposed on the identification sleeve, wherein said indicia is configured for disposition behind the user's ear. A protective sleeve fabricated from a polymeric material is superposed with the identification sleeve.

In a still further aspect, the present invention includes a combination ear pad and identification device for eyeglass frames including a temple bar having a distal end configured for engagement with a user behind the user's ear. The device includes an inner sleeve configured for substantially concentric engagement with the distal end. Identification indicia is disposed on said inner sleeve, so that the indicia is configured for disposition behind the user's ear. The indicia is disposed on opposite sides of said inner sleeve. A substantially transparent outer sleeve superposed with said inner sleeve is fabricated from a non-toxic polymeric material. The inner and outer sleeves form a pad configured to provide cushioned, more comfortable engagement of the eyeglasses with the user.

In addition, another aspect of this invention includes a method of applying identification indicia to a eyeglass frame having a temple bar with a distal end configured for engagement with a user behind the user's ear, the method includes:

(a) providing an identification sleeve fabricated from heat-shrinkable tubing having identification indicia thereon;

(b) heat shrinking the identification sleeve onto the distal end;

(c) providing a protecting sleeve fabricated from a non-toxic heat-shrinkable polymeric tubing material; and (d) heat shrinking the protective sleeve onto superimposed engagement with at least a portion of the identification sleeve.

The present invention provides, in a different aspect, a method of recovering lost eyeglasses, this method including the steps of:

(a) applying a unique identification indicia and third party contact information to the eyeglasses;

(b) recording the identification indicia and contact information for the owner;

(c) receiving a communication from a finder including the unique identification indicia of a lost pair or eyeglasses;

(d) retrieving the contact information for the owner corresponding to the unique identification indicia of said receiving step c; and (e) communicating with the finder to arrange for return of the eyeglasses to the owner.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Referring to the figure set forth in the accompanying Drawing, the illustrative embodiments of the present invention will be described in detail hereinbelow.

Where used in this disclosure, the term "owner" when used in connection with an element described herein shall refer to a person who installs the identification device on a pair of eyeglasses or a person who purchases the eyeglasses with the identification device already installed on the eyeglasses by a third party. The term "eyeglasses" shall refer to prescription glasses, sunglasses and any other glasses for the eyes. The term "finder" shall refer to any person who finds a pair of eyeglasses having the identification device of the present invention attached thereto. Similarly, the term "recovery service company" shall refer to a company that facilitates the recovery process for a pair of eyeglasses having an identification device.

Figure 1:
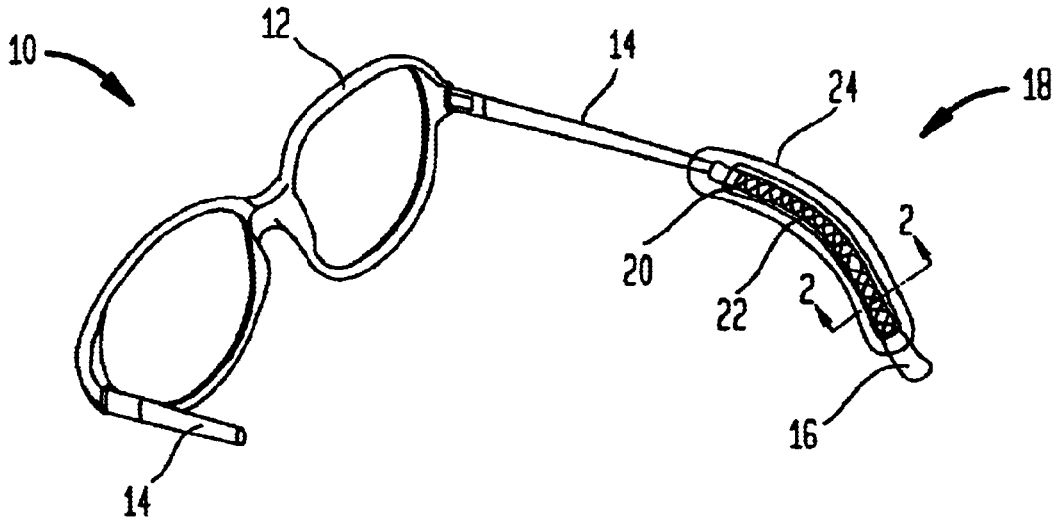
FIG. 1 is a perspective view with portions broken away, of an eyeglass frame coupled with an identification device of the present invention.

Referring now to FIG. 1, the apparatus of the present invention is more thoroughly described. As shown in FIG. 1, there is a typical pair of eyeglasses 10, that includes a frame 12 having a set of temple bars 14 which allows the frames to extend over and behind the eyeglass wearer's ears. The end of the temple bar 14 that extends behind the ear is called the curved end (or distal end) 16 of the temple bar 14.

Figure 2:
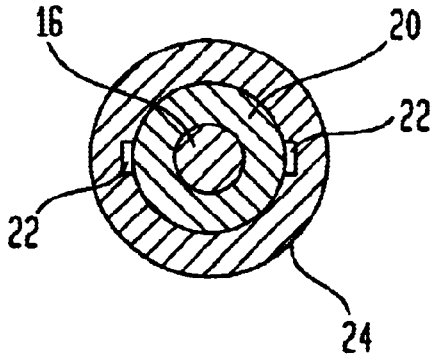
FIG. 2 is a cross-sectional view, on an enlarged scale, taken along 2—2 of FIG. 1.
Figure 3:
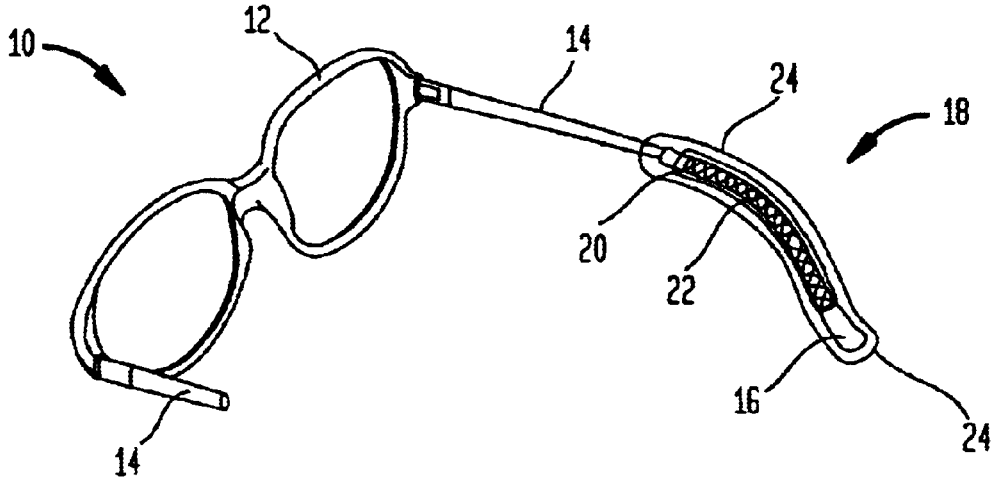
FIG. 3 is a view similar to that of FIG. 1, of an alternate embodiment of the identification device.

In one embodiment, an identification device 18 is attached in concentric superposed engagement with the curved end 16 of the temple bar 14 as shown in FIGS. 1 and 2. The identification device 18 may, however, be attached to any part of the eyeglass frame 12. The identification device 18 includes an identification sleeve 20 that has an identification marking (i.e., indicia) 22 thereupon. The identification sleeve 20 may be fabricated from heat-shrinkable polyolefin resin, polyvinyl chloride or other suitable material. The sleeve 20 has an initial diameter (i.e., before heating) sized to provide a loose sliding fit over the end 16 of the temple bar 14. In the embodiment as shown in FIG. 1, the sleeves are open at both ends, however in an alternate embodiment, the ends of the identification and protective sleeves may be closed. For example, FIG. 3 illustrates one embodiment wherein the protective sleeve has a closed end 24.

Examples of a suitable material for use in sleeve 20 are known as Sumitube™ or Sumimark™ flexible polyolefin general purpose tubing, respective serial numbers are SM-24 and SM-12, available from Sumitomo Electric, having an I.D. as supplied of 0.046 inches through 2 inches, and a shrinkable ratio of 2:1 or 3:1. Another suitable material is Daflex™ or Daflon™ shrinkable polyolefin tubing, available from Daburn Corporation. An alternative to using an identification sleeve 20 is to use a flat label having an identification marking on it.

The identification marking 22 on the identification sleeve 20 is preferably comprised of an identification code and a toll free telephone number. Thermal printing, heat stamping, foil stamping, laser or other suitable means may be used for marking the identification sleeve 20. An example of a thermal printing machine suitable for use in conjunction with the present invention is a Sumimark thermal transfer tube printer which is available from Sumitomo Electric of Sunnyvale, Calif. Each identification sleeve 20 will have a unique identification code that is associated with each individual owner recorded in a central database.

The protective sleeve 24 is disposed in concentric superposed engagement with the identification sleeve 20 and temple bar 14. The protective sleeve 24 may be fabricated from clear, non-toxic, heat-shrinkable polyvinyl chloride or other suitable material. In an alternative embodiment, the protective sleeve 24 may be fabricated from a clear-drying, non-toxic, liquid enamel that may be applied over the identification sleeve 20 and frame 12.

FIG. 2 is a cross-sectional view, taken along 2—2 of FIG. 1, which shows the protective sleeve 24 covering the identification sleeve 20. FIG. 2 also shows the end 16 of the temple bar 14 (FIG. 1) disposed within the identification sleeve 20.

FIG. 3 illustrates an alternate embodiment wherein the protective sleeve has a closed end 24. This closed end shape advantageously covers the curved end of a temple bar and therefore may further reduce the possibility of dirt and bacteria accumulation under the protective sleeve 24.

A preferred embodiment of the invention having been described, the following is a description of an exemplary method of a using the identification device 18 with an eyeglass frame 12. In one embodiment, this identification sleeve 20 is placed over the curved end 16 of one of the temple bars 14. However, the identification sleeve 20 may be placed over any part of the eyeglass frame 12. The owner or user slides the identification sleeve 20 over the eyeglass frame 12 at a desired location and then applies heat to shrink the identification sleeve 20 firmly into engagement with the frame 12 as shown in the FIGS. Heat may be applied to the identification sleeve 20 in various ways; for example, the identification sleeve 20 may be dipped in hot water or blown with hot air from a hair dryer.

Next, the protective sleeve 24 is then concentrically superimposed over the identification sleeve 20 and heat shrunk in a similar manner as described above. In a preferred embodiment, after being shrunk, both ends of the protective sleeve are approximately 0.125 inches longer than the respective ends of the identification sleeve.

The next step is the owner or user registers the identification device 18 with a central database that may be operated and/or maintained by third party such as a recovery service company or similar organization. A representative from the recovery service company may ask the owner if she wants her address and telephone number kept confidential from a finder. The representative may also request other pertinent contract information such as preferred method of contacting the owner.

A preferred embodiment of a method of use of the invention having been described, the following steps are a description of the method of recovering lost eyeglasses 10 using the identification device 18 and recovery service company.

First, the recovery service company will receive a call or other communication from a finder who has found a pair of glasses 10 having an identification device 18 thereon. The recovery company then uses the unique indicia on the device 18 to retrieve the owner's contact information. The recovery service then determines the owner's preferred method of recovery. The recovery company then communicates with the finder to agree on a method of returning the eyeglasses 10 to the owner. The recovery service company may use various methods of returning the eyeglasses 10, such as, the company may forward the finder a postage paid envelope or provide the finder with the owner's name and number. Upon successful return of the eyeglasses 10 to the owner, the company may send a courtesy reward package to the finder.

This identification device 18 has many advantages, for example, it has no indents or recesses and therefore does not tend to accumulate dirt and bacteria.

In addition, the heat shrinkable sleeves 20 & 24 attach firmly to the frame 12 and therefore are less likely to curl up or fall off, even when the sleeves 20 & 24 are attached on the curved end 16 of a temple bar 14. This identification device 18 requires no expensive, toxic or messy adhesives. The protective sleeve 24 also helps prevent the identification markings 22 from being worn off over time. Lastly, the identification device 18 may be cut to various lengths to fit most any pair of eyeglasses 10.

The method of registering and recovery has many advantages, for example, the toll free number on the identification device 18 encourages a finder to report the discovery of the lost eyeglasses 10. The identification code and recovery service company database facilitates the quick identification of the owner of the eyeglasses 10 and best method of retrieval to the owner.

In further alternative embodiments, the protective sleeve 24 and/or identification sleeve 20 may be fabricated from a food grade non-toxic PVC, such as meets the requirements of 21 CFR 177 and/or former 40 CFR 789, such as sold under the designation HS/FDA/9, by Insultab Corp. of Woburn, Mass. Such tubing has conventionally been used for food and beverage (non-toxic) applications, such as to provide a flexible conduit for transport of liquid to be consumed by a user. (An exemplary use includes soft drink preparation). It has been found, however, that when used in conjunction with the present invention, such tubings provide a nominally non-toxic assembly which may advantageously be disposed in prolonged contact with a user's skin without generating skin irritation.

Alternatively, other non-toxic materials may be used. For example, a USP Class VI medical grade polyolefin material may be used to fabricate the protective sleeve 24. An example of such a material is known as HS-914, available from Insultab of Woburn, Mass. However, when shrunk, this material tends to becoming translucent, to thereby obscure the underlying markings. Thus, although not presently commercially available, it is anticipated that in the future a USP Class VI grade PVC may be developed, which may be used to fabricate sleeve 24.

In a still further alternative embodiment, identification marking 22 may be applied to identification sleeve 20 on two opposite sides. This may be effected, for example, using a two-step process in which the sleeve 20 passes sequentially through two discrete printing machines of the type described hereinabove. The first printing machine may print one side of the sleeve 20, while the second printing machine may print the opposite side. (Alternatively, a single printing machine having the ability to simultaneously print on opposite sides may also be used.) Printing the markings 22 on opposite sides of the sleeve 20 advantageously takes advantage of the relatively large surface area provided by the use of a material that extends entirely circumferentially about the end 16 of the temple bar 14 such as shown in FIG. 2. This circumferential configuration provides substantially more surface area than other eyeglass marking approaches that place all indicia on a single (i.e., inside or user-side) surface of the temple bar. Such two-sided printing also advantageously helps ensure that the printed information 22 will be noticed by a finder of the eyeglasses 12, and that the information 12 will be legible.

The present invention also enables use of such double-sided printing because, as discussed hereinabove, the sleeves 20 and 24 are sized and shaped for placement on the distal end 16 that is adapted for engagement with a user behind the user's ear. Advantageously, such placement of the sleeves enables the user's ear to effectively conceal the markings while the eyeglasses are being worn, thus eliminating any aesthetic concerns associated with placing markings on the outside (i.e., the side facing away from the user) surface of the temple bar 14. Such placement also enables the sleeves 20 and 24 to provide the dual functions of an identification device, and of an ear pad to enhance the user-comfort of the eyeglasses.

The padding effect of the invention is provided by the combination of several factors. The skilled artisan will recognize that the sleeves 20 and 24 tend to gain thickness when shrunk in place on the temple bar 14. This thickness is further enhanced by the two-layer construction provided by the superposed sleeves. Such thickness, as well as the relatively compliant nature of the polymer (e.g., PVC) used to fabricate the sleeves 20 and 24, combine to enable embodiments of the present invention to serve as an effective ear pad which has advantageously been shown to provide relatively improved comfort to the eyeglass wearer.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. An identification device for eyeglass frames, comprising:

an eyeglass frame including at least one temple bar with a distal end adapted for placement on a wearer at least partially behind the wearer's ear;

an identification sleeve configured for substantially concentric engagement with the distal end of a portion of the temple bar;

identification indicia disposed on said identification sleeve;

said indicia being disposed on opposite sides of said identification sleeve;

a substantially transparent protective sleeve being superposed with said identification sleeve; and said protective sleeve being fabricate from a non-toxic polymeric material.

2. The identification device of claim 1, wherein said identification sleeve is fabricated from a polymeric material.

3. The identification device of claim 2, wherein said identification sleeve is fabricated from polyolefin resins.

4. The identification device of claim 2, wherein said identification sleeve comprises heat shrinkable polyolefin tubing.

5. The identification device of claim 1, wherein said identification sleeve is adapted to couple with a temple bar of the eyeglass frame.

6. The identification device of claim 1, wherein said identification indicia comprises an alphanumeric code.

7. The identification device o claim 1, wherein said identification indicia is applied by mechanical stamping.

8. The identification device of claim 1, wherein said identification indicia is applied by mechanical stamping.

9. The identification device of claim 1, wherein said identification indicia is applied by heat stamping.

10. The identification device of claim 1, wherein said identification indicia is applied by foil stamping.

11. The identification device of claim 1, wherein said identification indicia is applied with a laser.

12. The identification device of claim 1, wherein said protective sleeve comprises a transparent plastic material.

13. The identification device of claim 1, wherein said protective sleeve comprises clear, non-toxic shrinkable polyvinyl chloride tubing.

14. The identification device of claim 1, wherein said protective sleeve is heat shrinkable for engagement with said identification sleeve.

15. The identification sleeve of claim 1, wherein said protective sleeve is heat shrinkable for engagement with the eyeglass frame.

16. A combination ear pad and identification device for eyeglass frames, comprising:

an eyeglass frame having at least one temple bar with a distal end adapted for placement on a wearer at least partially behind the wearer's ear;

an inner sleeve configured for substantially concentric engagement with the distal end of the eyeglass temple bar;

identification indicia disposed on said inner sleeve;

said indicia being disposed on opposite sides of said inner sleeve;

a substantially transparent outer sleeve superposed with said inner sleeve; and said outer sleeve being fabricated from a non-toxic polymeric material;

wherein said inner and outer sleeve form a pad configured to provide cushioned engagement of the eyeglass frame with a user.

* * * * *